US006020857A

United States Patent [19]

Podger

[11] Patent Number: 6,020,857

[45] Date of Patent: Feb. 1, 2000

[54] STRENGTHENED QUAD ANTENNA STRUCTURE

[76] Inventor: James S. Podger, 55 Gradwell Drive, Scarborough, ON, Canada, M1M 2N1

[21] Appl. No.: 09/047,356

[22] Filed: Mar. 25, 1998

[30] Foreign Application Priority Data

Feb. 23, 1998 [CA] Canada ..... 2223688

[51] Int. Cl.[7] ..... H01Q 11/12; H01Q 1/12

[52] U.S. Cl. ..... 343/742; 343/891

[58] Field of Search ..... 343/742, 891, 343/792.5

[56] References Cited

U.S. PATENT DOCUMENTS

| | | | |
|---|---|---|---|
| D. 213,375 | 2/1969 | Habig | D26/14 |
| 2,210,491 | 8/1940 | Lewis | 343/891 |
| 2,537,191 | 1/1951 | Moore | 250/33.67 |
| 3,210,767 | 10/1965 | Isbell | 343/792.5 |
| 3,268,899 | 8/1966 | Walden | 343/741 |
| 3,434,145 | 3/1969 | Wells | 343/726 |
| 3,491,361 | 1/1970 | Campbell | 343/741 |
| 4,595,928 | 6/1986 | Wingard | 343/742 |
| 5,790,082 | 8/1998 | Podger | 343/792.5 |

OTHER PUBLICATIONS

Dodd, P., "Design of An All–Metal Quad,"*The Antenna Experimenter's Guide*, 2nd ed. (Radio Society of Great Britain, 1996), pp. 98–99.

Haviland, R. P., "Spreader–Fed Quad Loops,"*The Quad Antenna*, (CQ Communications, Inc., 1993). pp. 110–112.

Sykes, B., "The Skeleton Slot Aerial System,"*The Short Wave Magazine*, Jan. 1995, pp. 594–598.

Kraus, J. D., "A Small But Effective 'Flat Top' Beam, "*Radio*, Mar. 1937, pp. 56–58.

Podger, J. S., Analysis Results, Two Meter Quad.

Podger, J. S., Analysis Results, Two Meter Strengthened Quad.

*Primary Examiner*—Don Wong
*Assistant Examiner*—Hoang Nguyen

[57] ABSTRACT

An antenna structure is disclosed that is a loop of conductors, approximately one wavelength in perimeter, plus a supporting conductor connected from one side of the loop to the opposite side. This antenna structure is connected to the associated electronic equipment, in a balanced manner with respect to the supporting conductor, effectively at either connection between the loop and the supporting conductor. Because of the balanced connection, the supporting conductor carries very little current and has very little influence on the electrical operation of the loop. Such a structure could be made stronger than the traditional one-wavelength loops supported by insulators, because metals are usually stronger than insulating materials.

48 Claims, 6 Drawing Sheets

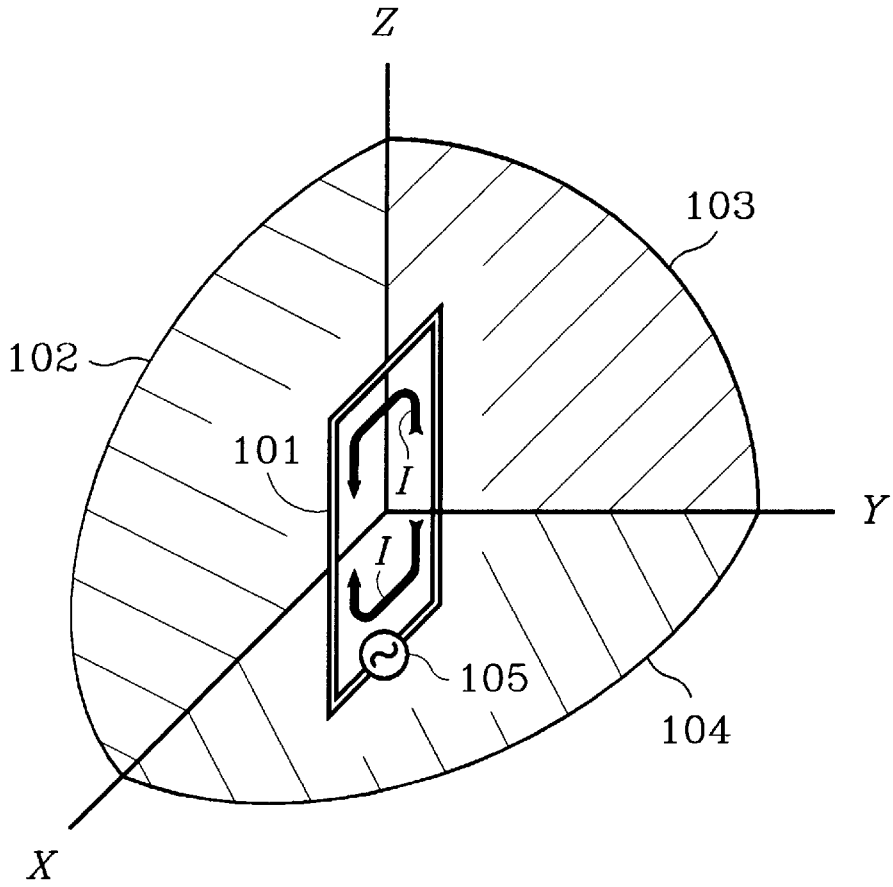
Prior Art *Fig. 1*
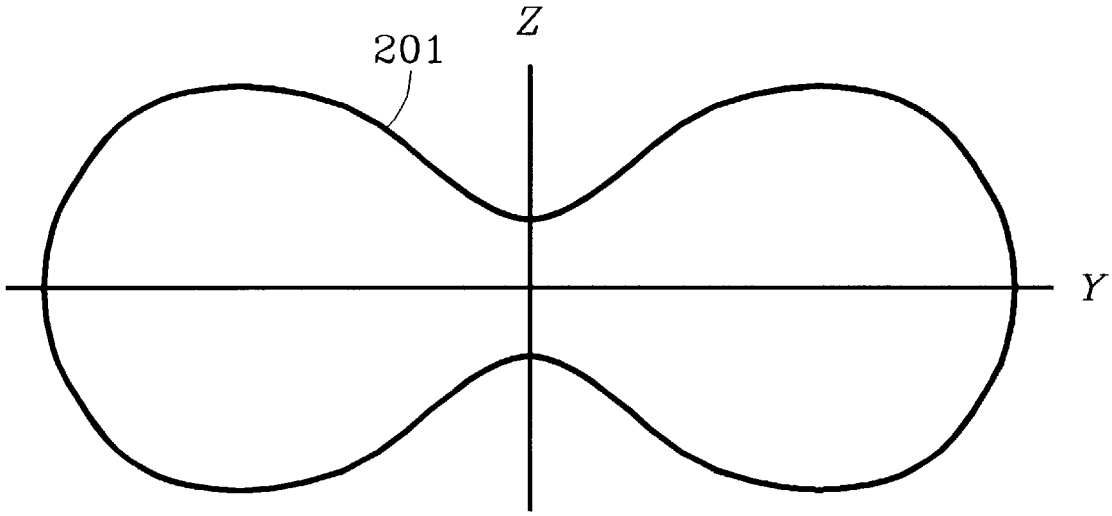
Prior Art *Fig. 2*

STRENGTHENED QUAD ANTENNA STRUCTURE

FIELD OF THE INVENTION

This invention relates to antennas, specifically antennas formed by loops of conductors approximately one wavelength in perimeter. This application is the U.S. version of Canadian patent application 2,223,668. Previous disclosures have shown that such loops yield advantages over the more traditional straight conductors approximately one-half wavelength long. The version that is a square loop, called a quad, has been particularly popular. Unfortunately, such antenna structures have been constructed using long insulators for mechanical support because it was thought that metal supports would unduly diminish the electrical performance of the antenna. Even though much progress has been made in finding strong insulators for this application, it is unlikely that insulators would be as strong as metals. Therefore, it is unlikely that antennas made with such loops would be as strong as antennas that are made entirely with metals. This invention improves the strength of such antenna structures by adding a metal support in such a way that it does not diminish the electrical performance of the antenna structure.

LIST OF DRAWINGS

The explanation of the prior art as well as the objects and advantages of the invention will be apparent from the following description and appended drawings, wherein:

FIG. 1 illustrates the conventional principal planes passing through a rectangular loop antenna;

FIG. 2 illustrates the simplified radiation pattern of quad antenna structures;

PRIOR ART

Figure 3:
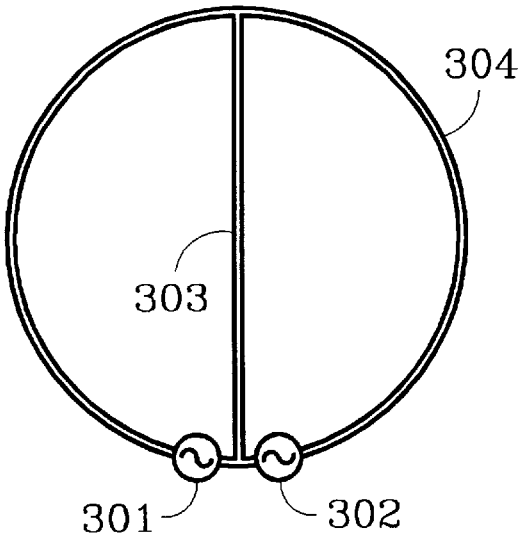
FIG. 3 illustrates a circular one-wavelength conducting loop with a central supporting conductor.
Figure 4:
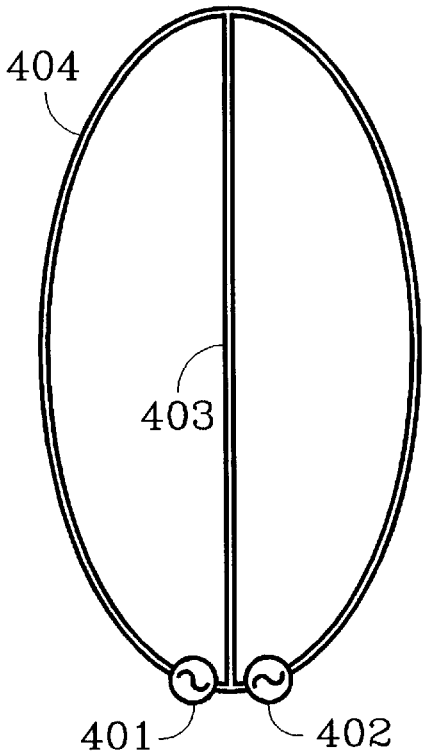
FIG. 4 illustrates an elliptical one-wavelength conducting loop with a central supporting conductor.
Figure 5:
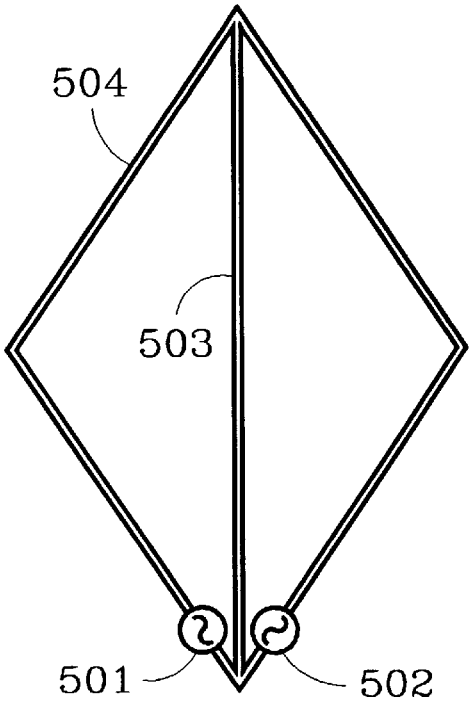
FIG. 5 illustrates a diamond-shaped one-wavelength conducting loop with a central supporting conductor.
Figure 6:
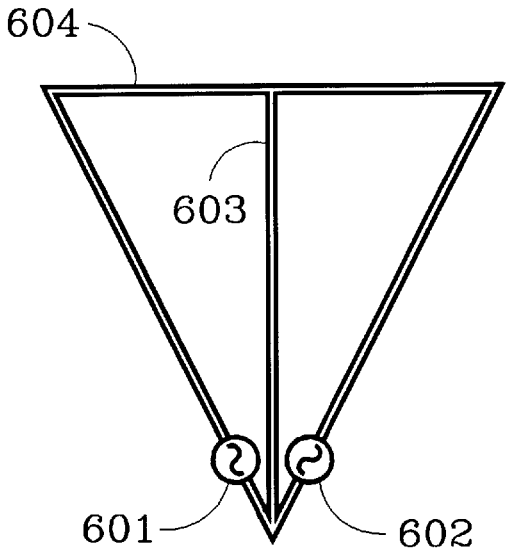
FIG. 6 illustrates a triangular one-wavelength conducting loop with a central supporting conductor.

The classical elementary antenna structure, called a half-wave dipole, is a straight conductor approximately a half wavelength long. One of its disadvantages is that it transmits or receives equally well in all directions perpendicular to the conductor. That is, in the transmitting case, it does not have not much gain because it wastes its ability to transmit in desired directions by sending signals in undesired directions. Another disadvantage is that it occupies a considerable space from end to end, considering that its gain is low. A third disadvantage is that it is susceptible to noise caused by precipitation. Yet another disadvantage is that if a high transmitter power were applied to it, in some climatic conditions, the very high voltages at the ends of the conductor could ionize the surrounding air producing corona discharges. These discharges could remove material from the conductor ends and, therefore, progressively shorten the conductors.

A significant improvement has been achieved by using loops of various shapes that are one-wavelength in perimeter. Such structures were made popular by Clarence C. Moore with his U.S. Pat. No. 2,537,191 on two-turn, one-wavelength loops. Of the various shapes, the square, called a quad, has been most popular, but it does not provide the most gain for a particular bandwidth. Mathematical analysis reveals that the circular shape is the best of the usual shapes and the triangle is the worst. However, the differences are small. Furthermore, if such structures were put into arrays, the differences in the individual structures would be obscured by the properties of the array.

Although the other advantages of these loops are important, the reason for the gain advantage is worth more discussion. To illustrate this advantage, FIG. 1 shows the rectangular version of them (101). The wide arrows in this diagram represent some aspects of the currents flowing in the conductors. All of these arrows attempt to denote the current patterns as the standing waves vary from each null through the maximum to the following null in each electrical half-wave of the current paths. At the centers of these arrows, the currents would reach the maxima for the paths denoted by these particular arrows. Where the arrowheads or arrow tails face each other, there would be current nulls and the currents immediately on either side of these points would be flowing in opposite directions.

As indicated by the generator symbol (105) in FIG. 1, when energy is fed into one side of the loop, maxima of current standing waves are produced at this feeding point and at the center of the opposite side of the loop, because it is a one-wavelength loop. The current minima and voltage maxima are half-way between these current maxima. One result of this current distribution is that the radiation is not uniform in the YZ plane (103). This is because there are, in effect, two conductors carrying the maximum current, the top and bottom of the loop in FIG. 1, which are perpendicular to that plane. Although these two currents are approximately equal in amplitude and phase, because of the symmetry, their fields would add in phase only in the direction of the Y axis. Because the distances from those two conductors to any point on the Y axis are equal, the phase shifts caused by the travelling time are equal. In other directions, the distances travelled to any point and, therefore, the phase shifts, are different for the two fields. Hence, the fields do not add in phase in those directions. The result is that the radiation pattern in the YZ plane is similar in shape to the radiation pattern (201) illustrated by FIG. 2. Hereinafter, this plane (103) will be called the principal H (magnetic field) plane, as is conventional.

Therefore, this structure has gain relative to a half-wave dipole antenna in the direction through the axis of the loop, which is the Y axis of FIGS. 1 and 2. If the distance between the feeding point and the opposite side of the loop were increased, the gain would be increased. Unfortunately, as is typical of antennas, the higher gain would be produced at the expense of bandwidth. Hereinafter in this description and the attached claims, the distance between the feeding point and the opposite side of the loop will be called the height of the structure. Also, hereinafter in this description and the attached claims, the dimension perpendicular to the height will be called the width.

Also because of this nonuniform radiation pattern, if plane 103 were vertical (horizontal polarization), signals transmitted at elevation angles near the horizon would be somewhat stronger because the component of the signal bounced off the land, which subtracts from the direct signal, would be weaker. This factor gave this antenna structure the reputation for being better if a high supporting tower were not available. Antennas located near the ground usually produce weak signals near the horizon.

This ability to produce stronger signals near the horizon is important in and above the very-high frequencies because signals generally arrive at low elevation angles. Fortunately, it is not difficult to put signals near the horizon at such frequencies because it is the height above ground in terms of wavelengths that matters and, with such short wavelengths, antennas easily can be placed several wavelengths above the ground. It also is important to put signals near the horizon at high frequencies because long-distance signals arrive at angles near the horizon and they usually are the weaker signals. This is more difficult to achieve, because the longer wavelengths determine that antennas usually are close to the ground in terms of wavelengths.

Another advantage of this kind of structure is that it is approximately one-half as wide as the half-wave dipole antenna and, therefore, it can be placed in smaller spaces. On the other hand, because its high-current paths are shorter than those of a half-wave dipole, they produce a slightly broader radiation pattern in the plane that is perpendicular to both the plane of the antenna (102) and the principal H plane (103). Hereinafter, this will be called the principal E (electric field) plane (104), as is conventional. This broader pattern reduces the antenna gain to a relatively small extent. The net effect is that these loops do not have as much an advantage in satellite applications, where sheer gain may be most important, as they do in terrestrial applications, where performance at low elevation angles may be most important.

The advantages of the quad have made it popular, but it has had a serious disadvantage. Because most of the antenna structure has a potential that is above the potential of ground, it has been traditionally supported by long insulators. This has not been a great problem in tropical areas of the world because bamboo for insulators is usually available at low cost. In colder climates, on the other hand, ice storms usually will damage such antennas. Although considerable progress has been made in producing insulators that are stronger than bamboo, it is still true that insulators are not as strong as metals. Therefore, the conventional wisdom is that arrays of quad antenna structures are better electrically than arrays of half-wave dipoles, but they are not as mechanically desirable.

Attempts have been made to produce such structures entirely with metal, but with limited success. In their U.S. Pat. Nos. 3,268,899 and 3,491,361, James Walden and Ralph Campbell suspended their loops by the centers of their top parts. In his U.S. design Pat. No. Des. 213,375, Harry Habig supported his triangle by a corner at the bottom. The tactic of Habig has the advantage of placing the structure at a greater height, but in order to hold the structure at the bottom in poor weather, an unusually strong supporting clamp would be needed. Supporting the structure at the top, as proposed by Walden and Campbell, would require a less strong support, but the antenna height would be less as well. In both cases, the wind forces on the structure are applied to the supporting clamps in the same direction. It would be more desirable to support the structure near its center, so that at least some of the wind forces on the top of the structure might cancel the forces on the bottom of the structure.

A better idea is to support the loop at both the bottom and top, as Peter Dodd proposed in his book, "*The Antenna Experimenter's Guide*". The difficulty with this idea is that either the whole structure is above the supporting tower or the lower supporting conductor will pass through the tower and prevent the rotation of the antenna. The wind would put less bending torque on the mast holding the antenna if the antenna could be supported at its center rather than at its bottom.

THE INVENTION

This conventional wisdom that supporting insulators are needed is based on the premise that these loops cannot be grounded to the supporting boom and tower. That is not quite true. If the structure were symmetrical, so that it were balanced with respect to ground, and if the structure were fed in a balanced manner, the feed point would be at ground potential. Because of the symmetry, away from that feed point there would be instantaneous voltages of equal magnitude but of opposite polarities at places that are equidistant from the feed point. The voltages would be of opposite polarities because no net current would flow between these points if they had voltages of the same polarity. At the point of the loop opposite from the feed point, these voltages of equal magnitude and opposite polarity would be the same voltage. The only voltage that satisfies those criteria is zero volts. That is, whatever the voltages would be at other places on the loop, they would reach zero at the place opposite the feed point. That is, that point would be at ground potential.

Therefore, a conductor may be connected between these two grounded points and no current will flow in it due to this connection. Also, since the currents in corresponding parts of the two sides of the structure are equal and opposite in phase, they will not induce any net current in the added central conductor. That is, if the structure were fed in a perfectly balanced manner, this additional conductor would have no electrical effect on the operation of the structure.

Of course, a perfect balance is not possible, but a reasonably balanced structure will have an insignificant amount of current in the central conductor. Indeed, it is amazing how little current flows in this central conductor even when the structure is fed in an unbalanced manner. However, a balanced feeding system is preferred.

FIGS. 3, 4, 5 and 6 show this kind of structure for four different shapes of one-wavelength loops. The pairs of generator symbols (301, 302, 401, 402, 501, 502, 601, and 602) imply that the connections to the associated electronic equipment should be provided in a balanced manner. Hereinafter in this description and the attached claims, the associated electronic equipment will be the kind of equipment usually connected to antennas. In addition to receivers and transmitters, it could be other devices such as radar or security equipment.

Parts 303, 403, 503, and 603 are the additional conductors that would be used to support the outside one-wavelength loops (304, 404, 504 and 604). Hereinafter in this description and the attached claims, these additional conductors will be called the supporting conductors. Usually these supporting conductors would be supported at the center of gravity of the structure, which would be the center of the supporting conductors in FIGS. 3, 4 and 5. The center of gravity would be elsewhere in FIG. 6 because, although the triangle is disposed symmetrically with respect to ground, it is not a completely symmetrical shape.

The following discussion will usually be about square loops only because the square shape has been most popular in the past. As stated above, circular loops are superior from an electrical point of view. The diamond shape may be regarded as superior from a mechanical point of view. With the addition of the supporting conductor, the diamond structure is two triangles. Because triangles are usually considered to be stronger than rectangles, the strengthened diamond may be potentially the strongest shape. However, in order for that to be true, the three sides of the triangles should be rigid. Instead, one probably would want to reduce the weight by having less strong parts at the outside corners where not much strength is required.

Figure 7:
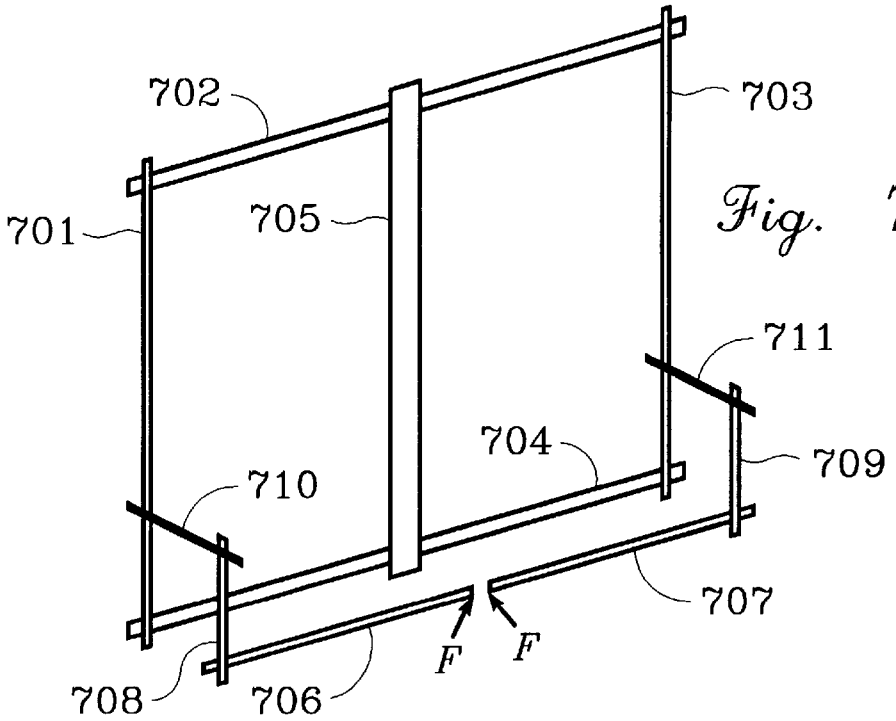
FIG. 7 illustrates a perspective view of the square version of this invention with an appropriate matching system, which hereinafter will be called a strengthened quad antenna structure, and which, perhaps, best illustrates the essence of the invention.

Since the impedances of antennas are seldom the desired impedances, some kind of matching system is usually required. FIG. 7 shows a square version of a one-wavelength loop with a more realistic impedance matching connection to the associated electronic equipment. The one-wavelength loop, comprising parts 701, 702, 703 and 704, is supported by part 705. Typically, it would be expected that part 705 would be connected at its center to a supporting boom. If the structure were large, it also would be expected that parts 702 and 704 would be relatively strong and parts 701 and 703 would have less strength because they are supported by parts 702 and 704. FIG. 7 indicates this by showing different cross-sectional areas for different parts. All of the conductors may have equal cross-sectional areas in small structures because not much strength may be required anywhere. Of course, a similar system could be used for circular or elliptical loops but, unless the structures were small, some insulated spreaders may be necessary to produce such curved shapes.

As it is with regular quad antenna structures, these one-wavelength loops need perimeters that are typically longer than a free-space wavelength in order to be resonant. Therefore, depending on the size of the conductors, one should not be surprised by side lengths for a square loop that are closer to 0.3 free-space wavelengths than 0.25 wavelengths.

Since the junction of parts 704 and 705 should be at ground potential, some kind of balanced feed system like a T match should be used around this effective feeding point. Unfortunately, if the structure were a square, each side of the square would be approximately only a quarter wavelength long. That may mean that the T parts, 706 and 707, may not be long enough to produce the desired matching impedance. In such a case, it may be necessary to have extensions to the T parts along the side parts, such as parts 708 and 709. Parts 710 and 711 are the conventional short circuits from the T parts to the main part of the antenna structure. As it is with the conventional T matching systems, tuning capacitors, balun transformers, etc. would be attached to the actual feed points F. It is possible that the use of capacitors between the feed points and the grounded junction of parts 704 and 705, in addition to or instead of the more conventional series capacitors, may make the extensions to the T parts unnecessary in some cases. Using the diamond shape, with its longer straight conductors, also would make bent T parts unnecessary.

This structure should not be confused with other similar structures. For example, Jefferson Wingard's U.S. Pat. No. 4,595,928 shows what appears to be a turnstile array of loops similar to FIG. 8 of this application. However, closer examination reveals that the loops are insulated, and the essence of the present invention is that the supporting conductor is connected to the loops.

For another example of mistaken identity, some people have fed such a structure in the center of part 705 as Bob Haviland showed in his book, *The Quad Antenna*. One result of that is that a considerable amount of current would flow in that part. Another consequence of that feeding method is that the structure would produce vertically polarized waves, if it were oriented like the structure of FIG. 7, whereas the feeding system disclosed here would produce horizontal polarization. What this other feeding method produces is a double-loop structure, which must be much larger to be resonant. Similar resonant double-loop structures, with central conductors which are common to the two loops, have been disclosed by B. Sykes in *The Short Wave Magazine* of January, 1955 and by Donald Wells in his U.S. Pat. No. 3,434,145.

Although this strengthened quad structure could be used at very-high and ultra-high frequencies, its advantages are perhaps more evident in the lower part of the high-frequency spectrum. At the higher frequencies, the double-loop structures might be small enough to be preferred. For a lower-frequency example, a two-element, 7-megahertz, dipole yagi array would be 60 to 70 feet wide, would not have a low angle of radiation because it probably would not be mounted high in terms of wavelengths, and much precipitation noise would be received. A similar array of quad antenna structures would be approximately one-half as wide, would have a lower angle of radiation, and it would receive less precipitation noise. However, the supporting insulators would be very long and, therefore, vulnerable to weather damage. The strengthened quad antenna structure would make practicable such a desirable antenna.

There are many conventional and acceptable means of connecting the various parts of strengthened quad antenna structures. For example, they could be bolted, held by various kinds of clamps, or soldered, brazed or welded with or without pipe fittings at the joints. As long as the effect of the means of connection upon the effective length of the parts is taken into account, there seems to be no conventional means of connecting antenna parts that would not be acceptable for strengthened quad antenna structures. However, before the final dimensions have been obtained, it is convenient to use clamps that allow adjustments to the lengths of the parts.

Application—Turnstile Arrays

Figure 8:
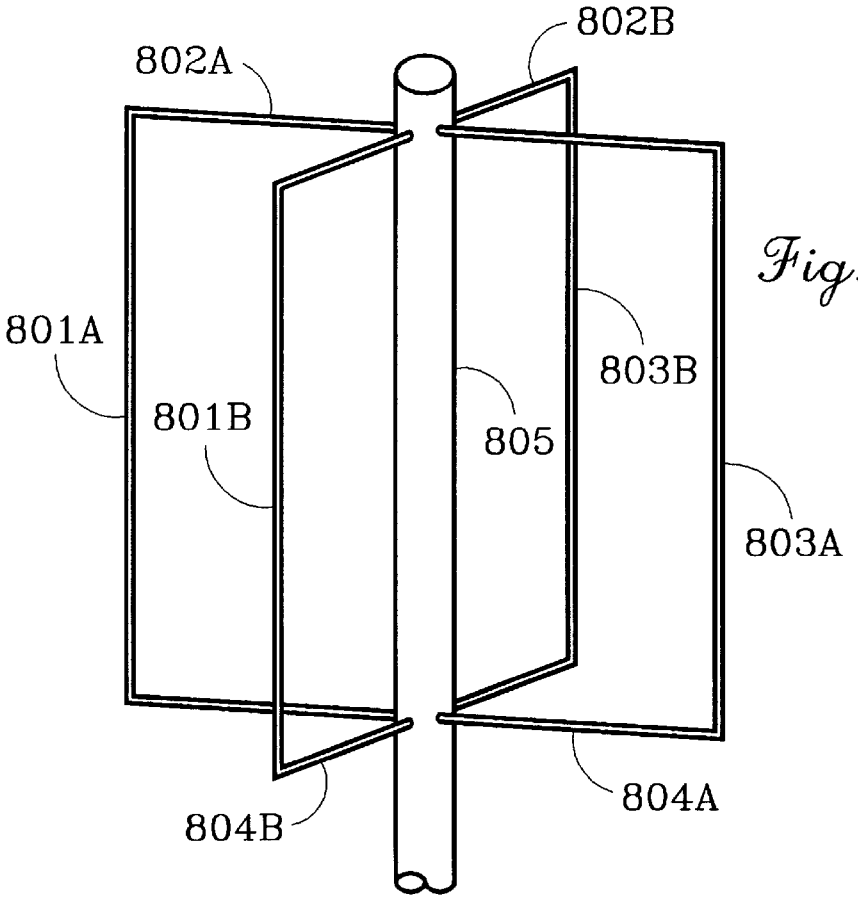
FIG. 8 illustrates a perspective view of a turnstile array of two strengthened quad antenna structures.

Strengthened quad antenna structures can be used in many of the ways that regular quad antenna structures are used. That is, combinations of them of particular sizes can be used to produce better antennas. For broadcasting or for networks of stations, a horizontally-polarized radiation pattern is often needed that is omnidirectional in the horizontal plane, instead of highly directional. To achieve this, an old antenna called a turnstile sometimes has been used. It comprises two half-wave dipoles oriented at right angles to each other and fed 90 degrees out of phase with each other. More gain can be obtained using quad antenna structures but, perhaps more important, as FIG. 8 shows, the strengthened quad also provides a considerable mechanical advantage. Parts 801A, 802A, 803A, and 804A form one quad and parts 801B, 802B, 803B, and 804B form the other quad. The supporting conductors, in this case, can be the single part 805, because it is at ground potential. Furthermore, that supporting conductor can be just the mast that supports the whole antenna. If more gain were required, more turnstile arrays could be stacked vertically and they could all be directly connected to the mast to produce a strong structure.

The electrical advantage of using quads instead of dipoles in such an array would be more directivity in the principal H plane for each turnstile of the whole array. That is, for a particular required gain, fewer turnstiles and fewer feeding points would be required. Since each turnstile could have T matching parts, tuning capacitors, balanced to unbalanced transformers, etc., reducing the number of feeding points is important. The feeding system was omitted from FIG. 8 because it is conventional and it would make the diagram more confusing.

Of course, turnstile arrays could be made with three or more strengthened quad antennas structures, spaced physically and electrically by less than 90 degrees. For example, three structures could be spaced by 60 degrees. Such structures may produce a radiation pattern that is closer to being perfectly omnidirectional, but such an attempt at perfection would seldom be necessary. More useful might be two structures spaced physically and electrically by angles that may or may not be 90 degrees, with equal or unequal energy applied. Such an array could produce a somewhat directive pattern, which might be useful if coverage were needed more in some directions than in other directions.

Application—Collinear and Broadside Arrays

Another application of strengthened quad antenna structures arises from observing that half-wave dipoles traditionally have been disposed in the same plane either end-to-end (collinear array), side-by-side (broadside array), or in a combination of those two arrangements. Often, a second set of such dipoles, called reflectors or directors, is put into a plane parallel to the first set, with the dimensions chosen to produce a somewhat unidirectional pattern of radiation. Alternatively, a reflecting screen has been used for the same purpose. Such arrays have been used on the high-frequency bands by short-wave broadcast stations, on very-high-frequency bands for television broadcast reception, and by radio amateurs.

Figure 9:
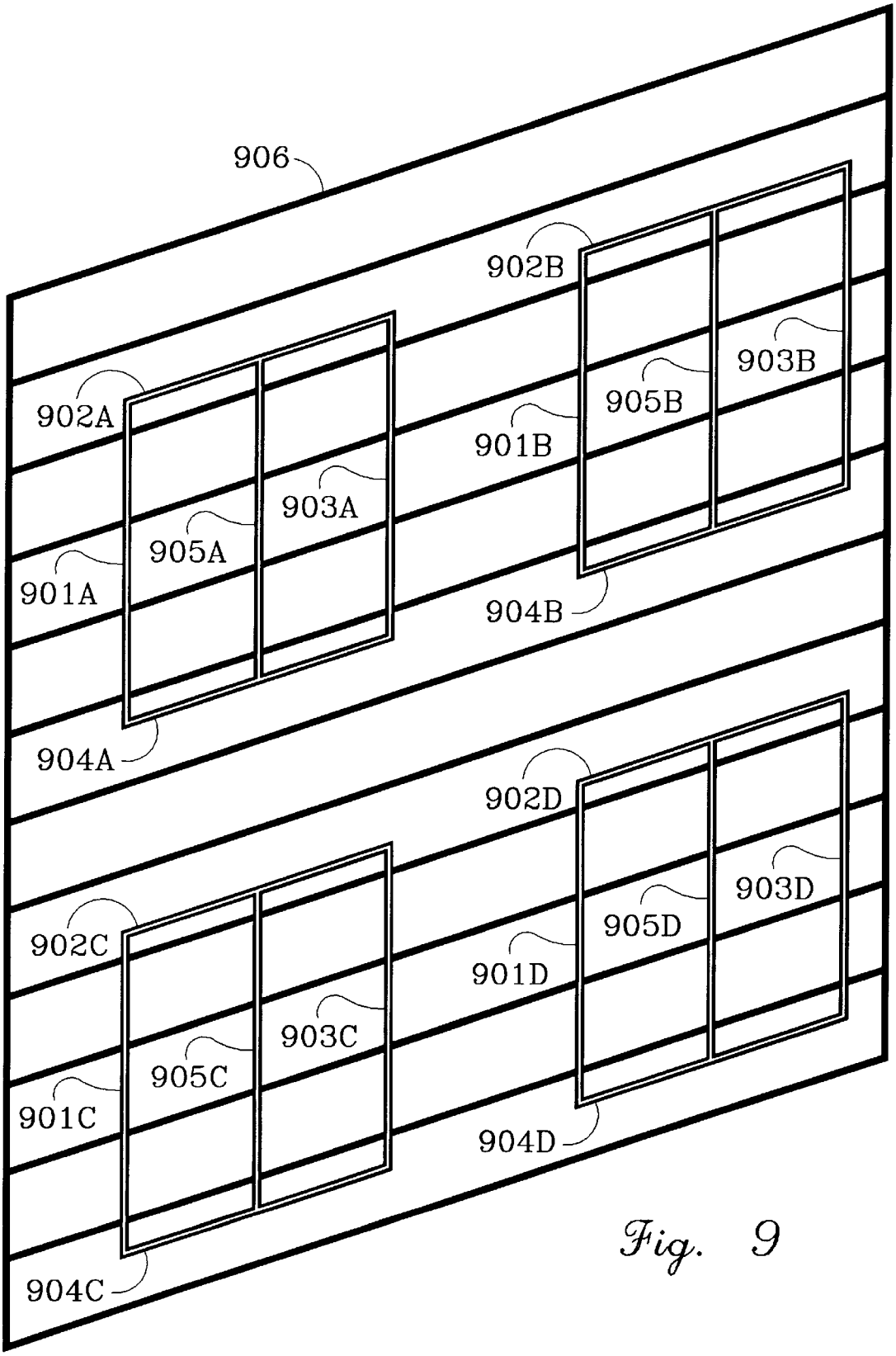
FIG. 9 illustrates a perspective view of four strengthened quad antenna structures in front of a reflecting screen to illustrate the collinear and broadside arrangements of such antenna structures.

The same tactics can be used with strengthened quad antenna structures. For example, FIG. 9 shows four such structures in front of a conducting screen (906). Because the loops are not necessarily squares, a different method of specifying a collinear or broadside array is appropriate. Perhaps it is useful to observe that the dipole collinear array has the dipoles aligned in the principal E plane and the broadside array has them aligned in the principal H plane. Perhaps more useful to this discussion is the observation that the supporting conductors are in the principal H plane. Therefore, a collinear array would extend perpendicular to the supporting conductors, and a broadside array would extend parallel to the supporting conductors.

In FIG. 9, the structure with the part names ending in A (parts 901A to 905A) is in a collinear arrangement with the structure having part names ending in B (parts 901B to 905B), because the array extends perpendicular to the supporting conductors. The C structure (parts 901C to 905C) and the D structure (parts 901D to 905D) are similarly disposed. The A structure is in a broadside arrangement with the C structure, because the array extends parallel to the supporting conductors. The B structure and the D structure are similarly disposed.

Perhaps the main advantage of using strengthened quad antenna structures rather than dipoles in such arrays is the less complicated system of feeding the array for a particular overall array size. That is, each strengthened quad antenna structure would perform in such an array as well as more than one half-wave dipole.

Sometimes collinear or broadside arrays of dipoles have used unequal distributions of energy between the dipoles to reduce the radiation in undesired directions. If such an unequal energy distribution were used with strengthened quad antenna structures, it might be easier to implement because of the less complicated feeding system.

Application—Yagi-Uda Arrays

Figure 10:
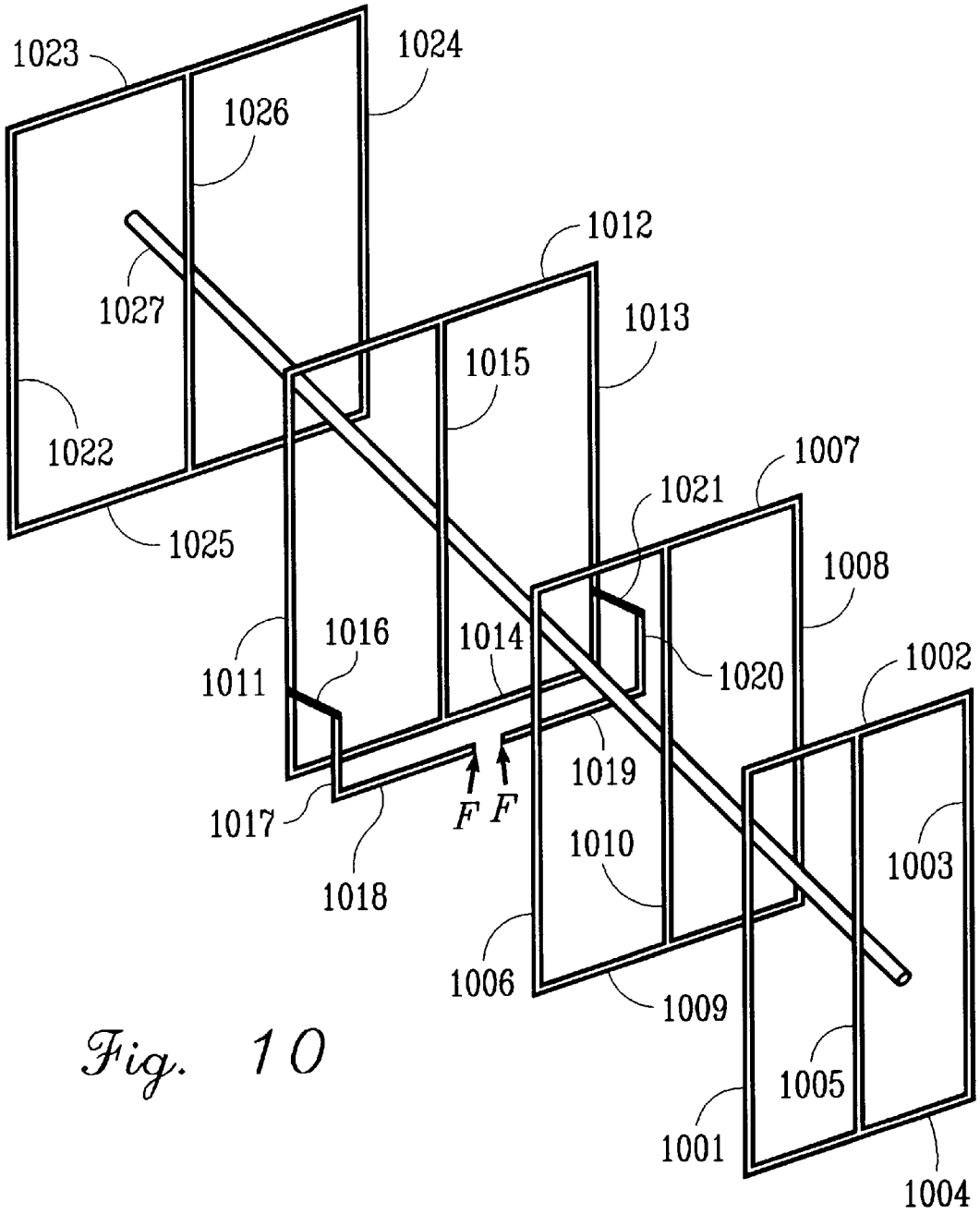
FIG. 10 illustrates a perspective view of a Yagi-Uda array of strengthened quad antenna structures.
Figure 11A:
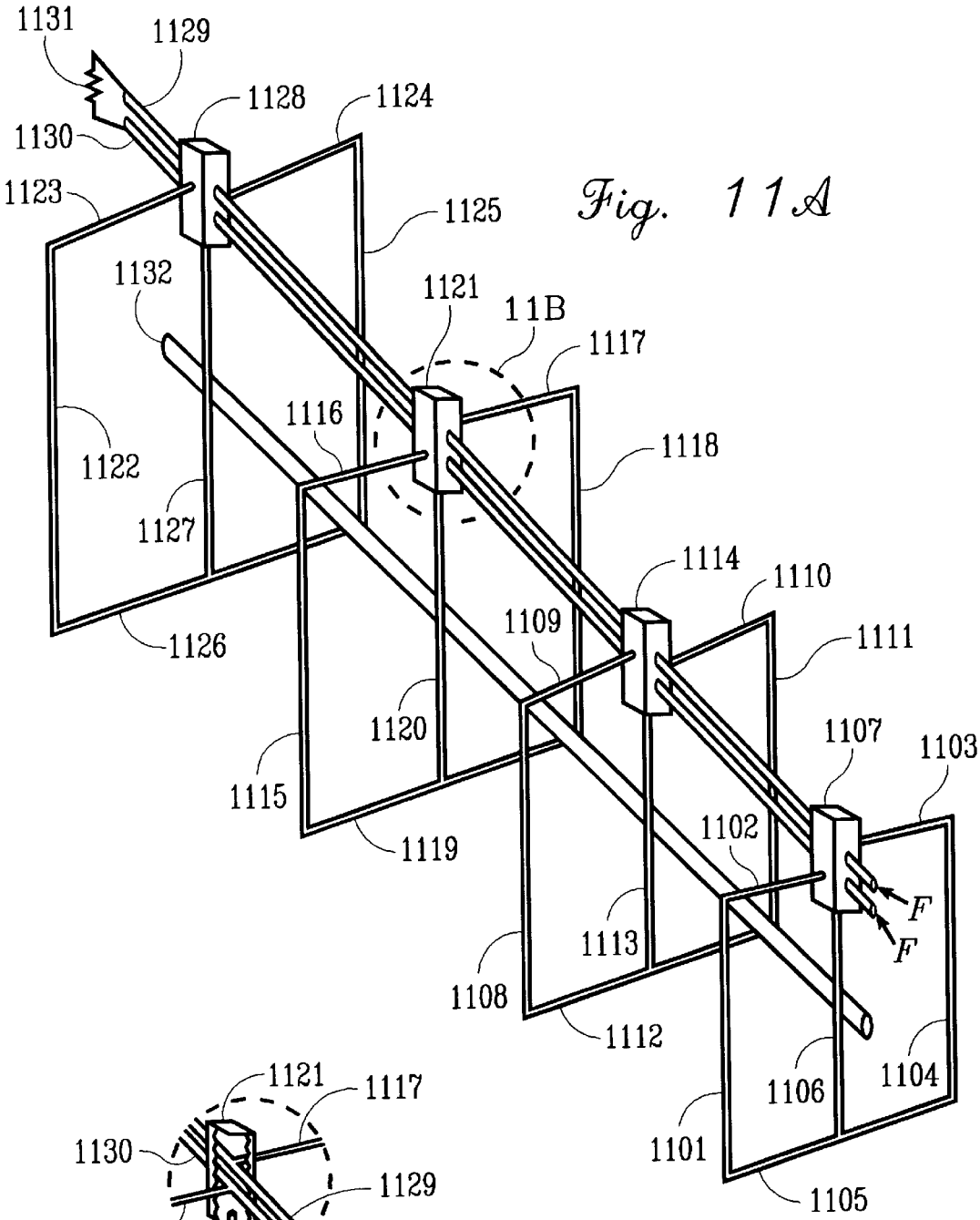
FIGS. 11A and 11B illustrate a perspective view of a log-periodic array of strengthened quad antenna structures.

Yet another application, commonly called an end-fire array, has several strengthened quad antenna structures disposed so that their loops have approximately common axes, as in FIGS. 10 and 11A. One strengthened quad antenna structure, some of them, or all of them could be connected to the associated electronic equipment. If the second strengthened quad antenna structure from the rear were so connected, as in FIG. 10, and the dimensions produced the best performance toward the front, it could logically be called a Yagi-Uda array of strengthened quad antenna structures. Parts 1011 to 1015, with the T match parts 1016 to 1021, would be called the driven structure, parts 1022 to 1026 would be called the reflector structure, and parts 1006 to 1010 and parts 1001 to 1005 would be called the first and second director structures respectively. Part 1027 is the boom to which the four strengthened quad antenna structures would be attached near the centers of the supporting conductors (1005, 1010, 1015 and 1026). Another less popular possibility would be to have an array of two such structures with the rear one connected, called the driven structure, and the front one not connected, called the director structure.

The tactic traditionally used for designing a Yagi-Uda array is to employ empirical methods rather than equations. This is partly because there are many combinations of dimensions that would be satisfactory for a particular application. Fortunately, there are computer programs available that can refine trial designs that are presented to the program. That is as true of strengthened quad arrays as it is for dipole arrays. To provide a trial design, it is common to make the driven structure resonant near the operating frequency, the reflector structure resonant at a lower frequency, and the director structures resonant at progressively higher frequencies from the rear to the front. Then the computer program can find the best dimensions near to the trial dimensions.

There is one factor that is worth considering with quad arrays that is not applicable to dipole arrays. Because the loop has high current places at the two ends of the supporting conductor, the loop acts somewhat like two dipoles separated by approximately a quarter wavelength. That is, the currents near the ends of the supporting conductor are the most important currents. Therefore, it is desirable to align the parts of the loops carrying these large currents in the direction of the desired radiation. This is somewhat important to achieve the maximum gain, but it is more important in order to suppress the radiation in undesired directions. Therefore, when the resonant frequencies of the structures in the array must be unequal, the supporting conductors preferably should be of equal length and the width of the structures should be changed to get the desired resonant frequencies. FIG. 10 illustrates this by having smaller widths at the front than at the rear.

Application—All-Driven Arrays

There are several possibilities for all-driven end-fire arrays but, in general, the mutual impedances and feeding systems make such designs rather challenging and the bandwidths can be very small. The log-periodic array is a notable exception. A more feasible all-driven array would be just two similar strengthened quad antenna structures, with common loop axes, which are fed 180 degrees out of phase with each other. The space between the structures is not critical, but one-eighth of a wavelength would be a reasonable value. This would be similar to the array presented by John Kraus in *Radio* of March, 1937, which is commonly called a W8JK array, after his amateur-radio call letters. Since the impedances of the two structures are equal when the phase difference is 180 degrees, it is relatively easy to achieve an acceptable bidirectional antenna by applying such tactics. If a balanced transmission line were used, the conductors going to one structure would simply be transposed. For coaxial cable, an extra electrical half wavelength of cable going to one structure might be a better method to provide the desired phase reversal. If the space were available, such a bidirectional antenna could be very desirable in the lower part of the high-frequency spectrum where rotating antennas may not be desirable because they are very large.

Another possibility is two such structures spaced and connected so that the radiation in one direction is almost canceled. An apparent possibility is a spacing between the structures of a quarter wavelength and a 90-degree phase difference in their connection. Other space differences and phase differences to achieve unidirectional radiation will produce more or less gain, as they will with half-wave dipoles. A problem with such arrays is that the impedances are not equal and the two impedances interact. Much adjustment of the matching systems and the phasing system may be necessary before a matched, unidirectional antenna is produced.

The log-periodic array of strengthened quad antenna structures is similar in principle to the log-periodic dipole antenna disclosed by Dwight Isbell in his U.S. Pat. No. 3,210,767. Hereinafter, that combination will be called a strengthened quad log-periodic array. Log-periodic arrays of half-wave dipoles are used in wide-band applications for military and amateur radio purposes and for the reception of television broadcasting. The merit of such arrays is a relatively constant impedance at the terminals and a reasonable radiation pattern across the design frequency range. However, this is obtained at the expense of gain. That is, their gain is poor compared to narrow band arrays of similar lengths. Although one would expect that gain must be traded for bandwidth in any antenna, it is nevertheless disappointing to learn of the low gain of such relatively large arrays.

If one observes the E-plane radiation pattern of a typical log-periodic dipole array, it appears to be a reasonable pattern of an antenna of reasonable gain because the major lobe of radiation is reasonably narrow. However, the principal H plane shows a considerably wide major lobe that indicates poor gain. This poor performance in the principal H plane is, of course, caused by the use of half-wave dipoles. Because dipoles have circular radiation patterns in the principal H plane, they do not help the array to produce a narrow major lobe of radiation in that plane. Strengthened quad antenna structures will improve the log-periodic array because they have some directivity in the principal H plane.

Figure 11B:
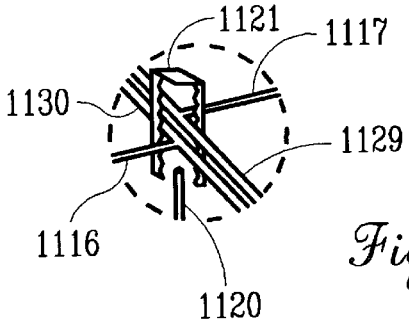

FIG. 11A shows such a log-periodic array with parts 1101 to 1132. FIG. 11B shows the connections inside one of the insulators, 1121. Typically, log-periodic arrays have more than four structures, but showing more, smaller structures would make the diagram less clear. A difficulty with conventional log-periodic dipole arrays is that the conductors that are feeding the various dipoles in the array also are physically supporting those structures. In FIGS. 11A and 11B, these conductors are parts 1129 and 1130. Hereinafter in this description and the attached claims, those conductors will be called the feeder conductors. The dipole array requires, first of all, that the feeder conductors must not be grounded. Therefore, in the conventional log-periodic dipole arrays, these feeder conductors must be connected to the supporting mast by insulators. Not only is this undesirable, because insulators are usually weaker than metals, but it is undesirable because it would be preferable to have a completely grounded antenna for lightning protection. Another difficulty is that because the characteristic impedance between the feeder conductors should be rather high, the large size of the feeder conductors needed for mechanical considerations requires a wide spacing between these conductors to obtain the desired impedance. That would require supporting insulators that are longer than one may want.

Because of these difficulties, the common method of constructing log-periodic dipole arrays is to support the dipoles by insulators connected to the grounded boom instead of using strong feeder conductors. Then the connections between the dipoles are made with a pair of wires that cross between adjacent structures. Not only is such a system undesirable because the dipoles are supported by insulators, but also it is undesirable because the feeder conductors do not have a constant spacing and, therefore, a constant characteristic impedance. Nevertheless, many people seem to be satisfied with this compromise.

Because the supporting conductors of strengthened quad antenna structures can be attached with metal clamps to the grounded boom, 1132, they offer particular benefits in log-periodic arrays. First, the whole structure is at ground potential for direct currents, although only the supporting conductors are at ground potential for radio frequencies as well. Secondly, although the supporting conductors, such as part 1120, are not directly connected to the feeder conductors, as FIG. 11B shows, the support for the feeder conductors is good. The feeder conductors and the top of the quads are supported not only by short, wide insulators, such as part 1121, but the rest of the loops are partly supported by the supporting conductors at the bottom. In a log-periodic array of regular quads, the feeder conductors would not have the support of the supporting conductors. Thirdly, because the feeder conductors are not required to support much, they can be small in diameter. Therefore, they can be spaced rather closely and still achieve the required characteristic impedance, thereby reducing the amount of supporting insulation between them.

It might appear unusual to have the feeder conductors at the top of the array in FIG. 11A, but it illustrates a solution to a possible problem. If the array were located just above a tower, feeder conductors at the bottom of the array would interfere with the tower. Such was the problem with Dodd's array with booms at both the top and bottom. In FIG. 11A, the problem is avoided by simply putting the feeder conductors at the top. Of course, the feeder conductors could be placed at the bottom of the structure if that were beneficial.

As stated above in the discussion of Yagi-Uda arrays, arrays that have strengthened quad antenna structures aligned from the front to the rear should preferably have supporting conductors of equal length. That is, the distances between the high-current parts of the loops should be equal. Equal supporting conductors is usually not a problem with Yagi-Uda arrays. This is partly because only one strengthened quad antenna structure in the array is connected to the associated electronic equipment, and partly because the range of frequencies to be covered is usually small enough that there is not a great difference in the sizes of the various strengthened quad antenna structures in the array. Therefore, it is preferable and convenient to have equal-length supporting conductors.

One reason why a strengthened quad log-periodic array presents a problem in this respect is because the purpose of log-periodic arrays is to cover a relatively large range of frequencies. Therefore, the range of dimensions is relatively large. It is not unusual for the resonant frequency of the largest structure in a log-periodic array to be one-half of the resonant frequency of the smallest structure. One result of this is that if one tries to achieve that range of resonant frequencies with a constant height, it is common that the appropriate height of the largest strengthened quad antenna structure in the array, for a desirable radiation pattern at the lower frequencies, will be larger than the perimeter of the loops of the smallest structure. Hence, such an equal-height array would be practicable only with a relatively narrow-band array.

Another reason for the problem is that all of the individual strengthened quad antenna structures are connected in a log-periodic array. Therefore, the relationship between the impedances of the structures is important. The problem of equal-height log-periodic designs is that the impedances of high and narrow strengthened quad antenna structures are different from the impedances of short and wide versions. The design of the connecting system, which depends on those impedances, may be unduly complicated if these unequal impedances were taken into account. In addition, the design may be complicated by the fact that the radiation pattern changes when the ratio of the height to width is changed. Therefore, instead of using equal heights, it may be preferable to accept the poorer gain and poorer suppression of radiation to the rear resulting from the nonaligned high-current conductors, in order to use strengthened quad antenna structures that are proportional to each other in height and width.

Sometimes, a compromise between the extremes of equal height and proportional dimensions is useful. For example, the resonant frequencies of adjacent strengthened quad antenna structures may conform to a constant ratio, the conventional scale factor, but the heights may conform to some other ratio, such as the square root of the scale factor.

Application—Log-Periodic Design Tactics

Whether equal-height strengthened quad antenna structures of proportional dimensions are used, the design principles are similar to the traditional principles of log-periodic dipole arrays. However, the details would be different in some ways. The scale factor ($\tau$) and spacing factor ($\sigma$) are usually defined in terms of the dipole lengths, but there are no such lengths available when the individual structures are not dipoles. It is better to interpret the scale factor as the ratio of the resonant wavelengths of adjacent strengthened quad antenna structures. If the design were proportional, that also would be the ratio of any corresponding dimensions in the adjacent structures. For example, for the proportional array of FIG. 11A, the scale factor would be the ratio of any dimension of the second largest structure formed by parts 1115 to 1120 divided by the corresponding dimension of the largest structure formed by parts 1122 to 1127. The spacing factor could be interpreted as the ratio of the individual space to the resonant wavelength of the larger of the two strengthened quad antenna structures adjacent to that space. For example, the spacing factor would be the ratio of the space between the two largest strengthened quad antenna structures to the resonant wavelength of the largest structure.

Some other standard factors may need more than reinterpretation. For example, since the impedances of strengthened quad antenna structures are not the same as the impedances of dipoles, the usual impedance calculations for log-periodic dipole antennas are not very useful. Also, since the antenna uses some strengthened quad antenna structures that are larger and some that are smaller than resonant structures at any particular operating frequency, the design must be extended to frequencies beyond the operating frequencies. For log-periodic dipole antennas, this is done by calculating a bandwidth of the active region, but there is no such calculation available for the strengthened quad log-periodic antenna. Since the criteria used for determining this bandwidth of the active region were quite arbitrary anyway, this bandwidth may not have satisfied all uses of log-periodic dipole antennas either.

However, if the array has a constant scale factor and a constant spacing factor, the structures are connected with a transmission line having a velocity of propagation near the speed of light, like open wire, and the connections are reversed between each pair of structures, the result will be some kind of log-periodic array. In FIG. 11A, that transmission line is formed by the two feeder conductors, 1129 and 1130. The connection reversal is achieved by alternately connecting the left and right sides of the strengthened quad antenna structures to the top and bottom feeder conductors. For example, as FIG. 11B shows, the left side top conductor of the second largest structure, 1116, is connected to the bottom feeder conductor, 1130, but the left side top conductor of the largest structure, 1123, apparently is connected to the top feeder conductor, 1129, in FIG. 11A. The frequency range, the impedance, and the gain of such an array may not be what the particular application requires, but it will nevertheless be a log-periodic structure. The task is just to start with a reasonable trial design and to make adjustments to achieve an acceptable design.

The reason why this design approach is practicable is because computer programs allow us to test antennas before they exist. No longer is it necessary to be able to calculate the dimensions with reasonable accuracy before an antenna must be made in the real world. The calculations can now be put into a spreadsheet, so the mechanical results of changes can be seen almost instantly. If the mechanical results of the calculations seem promising, an antenna simulating program can show whether the design is electrically acceptable to a reasonable degree of accuracy.

To get a trial log-periodic design, the procedure could be as follows. What probably would be known is the band of frequencies to be covered, the desired gain, the desired suppression of radiation to the rear, the desired length of the array, and the number of strengthened quad antenna structures that could be tolerated because of the weight and cost. The first factors to be chosen would be the scale factor ($\tau$) and the spacing factor ($\sigma$). The scale factor should be rather high to obtain proper operation, but it is a matter of opinion how high it should be. Perhaps a value of 0.88 would be a reasonable minimum value. A higher value would produce more gain. The spacing factor has an optimum value for good standing wave ratios across the band, good suppression of the radiation to the rear, and a minimum number of strengthened quad antenna structures for a particular gain. Perhaps it is a good value to use to start the process. The following equation was derived from the traditional curve for the optimum spacing factor.

$$\sigma_{opt}=0.2435\tau-0.052$$

Since the resonant frequencies of the largest and smallest strengthened quad antenna structures cannot be calculated yet, a good tactic is just to choose a pair of frequencies that are reasonably beyond the actual operating frequencies. These chosen frequencies allow the calculation of the number (N) of strengthened quad antenna structures needed for the trial value of the scale factor ($\tau$).

$$N=1+\log(f_{min}/f_{max})/\log(\tau)$$

Note that this value of N probably will not be an integer, which it obviously must be. The values chosen above must be changed to avoid fractions of strengthened quad antenna structures.

The calculation of the length of the array requires the calculation of the wavelength of the largest strengthened quad antenna structure. Of course, this can be done in any units.

$$\lambda_{max}=9.84\times10^8/f_{min}\text{ft}$$

$$\lambda_{max}=3\times10^8/f_{min}\text{m}$$

The length will be in the same units as the maximum wavelength.

$$L=\lambda_{max}\sigma(1-f_{min}/f_{max})/(1-\tau)$$

Therefore, the input to the calculations could be $f_{min}$, $f_{max}$, $\tau$ and $\sigma$, and the desired results could be N and L. Using the optimum value of the spacing factor, the calculation usually would produce a design that was longer than was tolerable. On the other hand, if a longer length could be tolerated, the scale factor could be increased to obtain more gain. To reduce the length, the prudent action is usually to reduce the spacing factor, not scale factor, because that choice will usually maintain a reasonable frequency-independent performance.

Once a tolerable design is revealed by these calculations, they should be tested by an antenna simulating program. The largest strengthened quad antenna structure would be designed using the lowest design frequency ($f_{min}$) The dimensions of the remaining structures would be obtained by successively multiplying the dimensions by the scale factor. The spaces between the structures would be obtained by multiplying the wavelength of the larger structure adjacent to the individual space by the spacing factor.

An additional factor needed for the program would be the distance between the feeder conductors to achieve the desired terminal impedance. A characteristic impedance of 200 ohms or more for the feeder conductors is traditionally recommended, so that is a reasonable value to try.

The gain, front-to-back ratio, and standing wave ratio of this first trial probably would indicate that the upper and lower frequencies were not acceptable. At least, the distance between the feeder conductors probably should be modified to produce the best impedance across the band of operating frequencies. With the information from the first trial, new values would be entered into the calculations to get a second trial design.

What is an acceptable performance is, of course, a matter of individual requirements and individual standards. For that reason, variations from the original recommended practice are common. First, the optimum value of the spacing factor usually is not used in log-periodic dipole antennas because it would make the antennas to long.

Secondly, although the extension of the feeder conductors behind the largest strengthened quad antenna structure was recommended in early literature, it is seldom used. The original recommendation was that it should be about an eighth of a wavelength long at the lowest frequency and terminated in the characteristic impedance of the feeder conductors, which is represented by the resistance symbol 1131. It was a more common practice to make the termination a short circuit.

If the antenna were designed for proper operation, the current in the termination would be very small anyway, so the termination does very little and usually can be eliminated. Actually, extending or not extending the feeder conductors may not be the significant choice. There may be a limit to the length of the feeder conductors. In that case, the choice may be whether it is better to raise the spacing factor to use the whole available length to support the strengthened quad antenna structures or to spend a part of that available length for an extension.

The log-periodic array of FIG. 11A illustrates the appropriate connecting points, F, to serve a balanced transmission line leading to the associated electronic equipment. Other tactics for feeding unbalanced loads and higher-impedance balanced loads also are used with log-periodic dipole antennas. Because these tactics depend only on some kind of log-periodic structure connected to two parallel tubes, these conventional tactics are as valid for such an array of strengthened quad antenna structures as they are for such arrays of half-wave dipoles.

Application—Large Arrays

Yagi-Uda and log-periodic arrays of strengthened quad antenna structures can be used in most of the ways that such arrays of half-wave dipoles are used. For example, two Yagi-Uda arrays could be oriented in the side-by-side or collinear orientation, or in the one-above-the-other or broadside orientation. Several arrays also could be disposed in both orientations, as are the single strengthened quad antenna structures of FIG. 9.

Since the gain of such large arrays tends to depend on the overall area of the array facing the direction of maximum radiation, it is unrealistic to expect much of a gain advantage from using strengthened quad antenna structures in large arrays of a particular overall size. However, there are other advantages. Since the individual arrays in the overall array could have more gain if they were composed of strengthened quad antenna structures, the feeding system could be simpler because fewer individual structures would be needed to fill the overall space adequately.

Having fewer individual structures to fill a particular overall space implies that there will be more space between the individual structures. Of course, that is just a recognition that there is a minimum space necessary between individual antenna structures so that the maximum gain can be obtained from the combination. As is well known, that minimum spacing depends on the directivity of the individual structures. It may be desirable to space the individual structures closer in order to suppress the radiation in undesired directions, but there is a minimum spacing for the maximum gain.

The above discussion also indicates that it is unrealistic to expect that long Yagi-Uda arrays of strengthened quad antennas structures will have large gain advantages over long Yagi-Uda arrays of half-wave dipoles. The principle of a minimum necessary spacing applies here as well. While it is not exactly true, one can consider that the strengthened quad antenna structures comprise dipoles, represented by the high-current conductors near the supporting conductors, that are joined by the rest of the loops. Presented in that manner, a Yagi-Uda array of strengthened quad antenna structures could be considered equivalent to a broadside array of two Yagi-Uda arrays of dipoles.

Each of these two Yagi-Uda arrays has some beam width in the principal H plane and, therefore, the two arrays should be separated by some minimum distance to produce the maximum gain for the combination. The longer the Yagi-Uda array is, of course, the narrower the individual H plane beams would be and the greater the spacing should be. That is, since the spacing is limited by the need to have approximately one-wavelength loops, a long Yagi-Uda array of strengthened quad antenna structures would not have as much gain as one might expect. In particular, a long array of such structures may not have much gain advantage at all over an array of half-wave dipoles of equal length.

That situation raises the question of how long Yagi-Uda arrays of strengthened quad antenna structures should be. One factor is that there is usually an advantage to making Yagi-Uda arrays of four strengthened quad antennas structures because four elements are usually required to produce an excellent suppression of the radiation to the rear of the array. Beyond that array length, the increase in gain for the increase in length probably will be disappointing because the distance between the high-current conductors cannot be increased very much. That is, the usual expectation that doubling the length producing twice the gain will not be realized. It probably will be wiser to employ more than one Yagi-Uda array of strengthened quad antenna structures in a larger collinear or broadside array. That is, if the array were long enough to suppress the radiation to the rear, it probably would be wiser to produce a wide and high array instead of an array that is long from the front to the rear.

CONCLUSION

Except for the restrictions of size, weight, and cost, strengthened quad antenna structures could be used for many of the purposes that antennas are used. Beside the obvious needs to communicate sound, pictures, data, etc., they also could be used for such purposes as radar or for detecting objects near them for security purposes.

While this invention has been described in detail, it is not restricted to the exact embodiments shown. These embodiments serve to illustrate some of the possible applications of the invention rather than to define the limitations of the invention.

I claim:

1. An improved antenna element, wherein said improved antenna element comprises:

(a) a loop of conductors, approximately disposed in one plane, which has a perimeter of approximately one wavelength; and (b) means for connecting said antenna element to the associated electronic equipment such that one current maximum is present on said loop approximately at the point of connection to said associated electronic equipment, a second current maximum is present approximately at the point on said loop that is opposite from said point of connection, and single current minima are present on said loop between said current maxima;

(c) and wherein the improvement comprises the addition of a supporting conductor, attached from said point of connection on said loop to said point on said loop that is opposite from said point of connection.

2. The improved antenna element of claim 1 wherein said supporting conductor is grounded.

3. The improved antenna element of claim 1 wherein said improved antenna element is supported at approximately the center of said supporting conductor.

4. The improved antenna element of claim 1 wherein:

(a) said loop of conductors is approximately a rectangle; and (b) said supporting conductor is attached approximately at the centers of two opposite sides of said rectangle.

5. The improved antenna element of claim 1 wherein:

(a) said loop of conductors is approximately a square; and (b) said supporting conductor is attached approximately at the centers of two opposite sides of said square.

6. The improved antenna element of claim 1 wherein said loop of conductors is approximately a circle.

7. The improved antenna element of claim 1 wherein:

(a) said loop of conductors is approximately an ellipse; and (b) said supporting conductor is disposed approximately along one of the axes of said ellipse.

8. The improved antenna element of claim 1 wherein:

(a) said loop of conductors is approximately a diamond shape; and (b) said supporting conductor is attached between opposite corners of said diamond shape.

9. The improved antenna element of claim 1 wherein:

(a) said loop of conductors is approximately a triangle having at least two approximately equal sides; and (b) said supporting conductor is attached from the corner of said triangle which connects said two approximately equal sides to approximately the center of the side opposite from said corner of said triangle.

10. The improved antenna element of claim 1 wherein at least one of the conductors has an approximately circular cross-sectional area.

11. The improved antenna element of claim 1 wherein at least one of the conductors has a solid cross-sectional area.

12. The improved antenna element of claim 1 wherein at least one of the conductors has a tubular cross-sectional area.

13. The improved antenna element of claim 1 wherein all the conductors have approximately equal cross-sectional areas.

14. The improved antenna element of claim 1 wherein not all of the conductors have approximately equal cross-sectional areas.

15. The improved antenna element of claim 1 wherein said supporting conductor is disposed approximately parallel to the ground.

16. The improved antenna element of claim 1 wherein said supporting conductor is disposed approximately perpendicular to the ground.

17. The improved antenna element of claim 1 wherein said supporting conductor is disposed neither approximately parallel to the ground nor approximately perpendicular to the ground.

18. An improved antenna system, comprising at least one antenna, each of those antennas comprising two antenna elements, wherein:

(a) each of said antenna elements comprises a loop of conductors, approximately disposed in one plane, which has a perimeter of approximately one wavelength;

(b) in each of said antennas, the planes of said antenna elements are disposed approximately perpendicular to each other;

(c) in each of said antennas, the intersection of said planes approximately passes through opposite points on said loops of conductors of both of said antenna elements;

(d) in each of said antennas, the corresponding points of said loops of conductors that are approximately at said intersection of said planes are attached to each other;

(e) in each of said antenna elements, the means of connecting to the associated electronic equipment is such that current maxima on said loops of conductors are present approximately where said loops of conductors are attached to each other, and single current minima on said loops of conductors are present between said current maxima;

(f) in each of said antennas, said means of connecting to said associated electronic equipment also is such that the corresponding currents in said two antenna elements are consistently related in amplitude by approximately equal ratios of values and are consistently unequal in phase by approximately equal amounts; and (g) said antennas are aligned so that the line of intersection of said two planes of each of said antennas is approximately the line of intersection of said two planes of the other antennas;

(h) and wherein the improvement to said improved antenna system consists of the addition, to each of said antennas, of a supporting conductor attached between the points where said loops of conductors are attached to each other.

19. The improved antenna system of claim 18 wherein said supporting conductor of at least one of said antennas is grounded.

20. The improved antenna system of claim 18 wherein the mast supporting said improved antenna system also is said supporting conductors of all said antennas.

21. The improved antenna system of claim 18 wherein the amplitudes of said corresponding currents of said two antenna elements are approximately equal and the phases of said corresponding currents are consistently unequal by approximately 90 degrees.

22. The improved antenna system of claim 18 wherein the relative amplitudes and phases of the currents in the corresponding conductors of said antennas and the distances between said antennas are such that the performance of said improved antenna system is maximized in the principal E plane.

23. The improved antenna system of claim 18 wherein the relative amplitudes and phases of the currents in the corresponding conductors of said antennas and the distances between said antennas are such that the performance of said improved antenna system is minimized in directions other than in the principal E plane.

24. The improved antenna system of claim 18 wherein the relative amplitudes and phases of the currents in the corresponding conductors of said antennas and the distances between said antennas are such that the performance of said improved antenna system is a beneficial compromise between maximizing said performance in the principal E plane and minimizing said performance in other directions.

25. An improved antenna system, comprising at least one antenna, each of those antennas comprising at least one antenna element, wherein:

(a) in each of said antenna elements, a loop of conductors is present, approximately disposed in one plane, which has a perimeter of approximately one wavelength;

(b) in each of said antenna elements, the improvement is the addition of a supporting conductor, attached from a first point on said loop of conductors to a second point on said loop of conductors that is approximately on the opposite side of said loop of conductors from said first point; and (c) in each of said antennas, means for connection to the associated electronic equipment are provided to at least one of said antenna elements such that, on said loops of said connected antenna elements, current maxima are present approximately at said points attached to the supporting conductors, and single current minima are present on said loops of said connected antenna elements between said current maxima.

26. The improved antenna system of claim 25 wherein at least one of said supporting conductors is grounded.

27. The improved antenna system of claim 25 wherein only one of said antennas is present in said improved antenna system.

28. The improved antenna system of claim 25 wherein the relative amplitude and phase of the currents in the corresponding conductors in said antennas and the distances between said antennas are chosen to maximize the performance of said improved antenna system to the front of said improved antenna system.

29. The improved antenna system of claim 25 wherein the relative amplitude and phase of the currents in the corresponding conductors in said antennas and the distances between said antennas are chosen to minimize the performance of said improved antenna system in directions other than to the front of said improved antenna system.

30. The improved antenna system of claim 25 wherein the relative amplitude and phase of the currents in the corresponding conductors in said antennas and the distances between said antennas are chosen to produce a beneficial compromise between maximizing the performance of said improved antenna system to the front of said improved antenna system and minimizing said performance in other directions.

31. The improved antenna system of claim 25 wherein:

(a) said supporting conductors of all of said antennas are approximately parallel to each other; and (b) said antennas are approximately aligned in the direction approximately parallel to said planes of said antenna elements that is approximately perpendicular to said supporting conductors.

32. The improved antenna system of claim 25 wherein:

(a) said supporting conductors of all of said antennas are approximately parallel to each other; and (b) said antennas are approximately aligned in the direction approximately parallel to said planes of said antenna elements that is approximately parallel to said supporting conductors.

33. The improved antenna system of claim 25 wherein:

(a) said supporting conductors of all of said antennas are approximately parallel to each other; and (b) said antennas are approximately aligned in the directions approximately parallel to said planes of said antenna elements that are either in the direction approximately perpendicular to said supporting conductors or in the direction approximately parallel to said supporting conductors, thereby producing a rectangular improved antenna system.

34. The improved antenna system of claim 25 wherein only one of said antenna elements is present in each of said antennas.

35. The improved antenna system of claim 34, further including a reflecting screen disposed behind said antenna system to produce a substantially unidirectional performance to the front of said improved antenna system.

36. The improved antenna system of claim 25 wherein:

(a) in each of said antennas, more than one of said antenna elements are present;

(b) in each of said antennas, said planes of said antenna elements are disposed approximately parallel to each other;

(c) in each of said antennas, said supporting conductors of said antenna elements are disposed approximately parallel to each other; and (d) in each of said antennas, said supporting conductors of said antenna elements are aligned approximately in the direction perpendicular to said planes of said antenna elements.

37. The improved antenna system of claim 36 wherein:

(a) just two of said antenna elements are present, with substantially equal dimensions, in each of said antennas; and (b) said means of connection to said associated electronic equipment also is such that the currents in the corresponding conductors of said two antenna elements are approximately equal in amplitude and approximately 180 degrees out of phase with each other.

38. The improved antenna system of claim 36 wherein:

(a) just two of said antenna elements are present, with substantially equal dimensions, in each of said antennas;

(b) said means of connection to said associated electronic equipment also is such that the currents in the corresponding conductors of said two antenna elements are approximately equal in amplitude; and (c) the distance between said antenna elements and the phase difference between said currents in said corresponding conductors of said antenna elements are such that the performance of said improved antenna system is minimized in one of the two directions perpendicular to said planes of said antenna elements.

39. The improved antenna system of claim 38 wherein:

(a) the distance between said antenna elements is approximately a free-space quarter wavelength; and (b) the phase difference between said currents in said corresponding conductors of said antenna elements is approximately a consistent 90 degrees.

40. The improved antenna system of claim 36 wherein:

(a) just two antenna elements in each of said antennas are present;

(b) only the rear antenna elements are connected to said associated electronic equipment; and (c) the dimensions of said antenna elements and the distances between said antenna elements are such that the performance of said improved antenna system is substantially unidirectional to the front of said improved antenna system.

41. The improved antenna system of claim 36 wherein:

(a) in each of said antennas, only the second antenna element from the rear is connected to said associated electronic equipment; and (b) in each of said antennas, the dimensions of said antenna elements and the distances between said antenna elements are such that the performance of said improved antenna system is substantially unidirectional to the front of said improved antenna system.

42. The improved antenna system of claim 41 wherein the dimensions of said antenna elements and the distances between said antenna elements are chosen to produce the maximum performance of said improved antenna system to the front of said improved antenna system.

43. The improved antenna system of claim 41 wherein the dimensions of said antenna elements and the distances between said antenna elements are chosen to produce the minimum performance of said improved antenna system in directions other than to the front of said improved antenna system.

44. The improved antenna system of claim 41 wherein the dimensions of said antenna elements and the distances between said antenna elements are chosen to produce a beneficial compromise between maximizing the performance of said improved antenna system to the front of said improved antenna system and minimizing said performance in other directions.

45. The improved antenna system of claim 36 wherein:

(a) the resonant frequencies of said antenna elements are progressively and approximately proportionally higher from the rear to the front of each of said antennas;

(b) the distances between said antenna elements are progressively and approximately proportionally shorter from the rear to the front of each of said antennas;

(c) within each of said antennas, the ratio of said resonant frequencies of all the adjacent antenna elements and the ratio of all the adjacent distances between said antenna elements are approximately equal ratios;

(d) within each of said antennas, all of said antenna elements are connected to each other, so that the phase relationship produced by the time taken for the energy to travel between them by said connection is essentially equal to the phase relationship that is consistent with travel at the speed of light;

(e) within each of said antennas, said connection between said antenna elements also produces a phase reversal between said adjacent antenna elements, in addition to the phase shift caused by the travelling time of the energy; and (f) the antenna elements at the front of each of said antennas are connected to said associated electronic equipment.

46. The improved antenna system of claim 45 wherein the differences in said resonant frequencies are caused by all the dimensions of said antenna elements approximately being proportionally different.

47. The improved antenna system of claim 45 wherein:

(a) said supporting conductors of each of said antenna elements are all approximately of equal length; and (b) the differences in said resonant frequencies are caused by said loops of conductors having different widths.

48. The improved antenna system of claim 45 wherein the method of producing said resonant frequencies is a compromise between having all the dimensions of said antenna elements approximately proportional to each other and having supporting conductors of approximately equal length.

* * * * *